US007357586B2

(12) United States Patent
Youn

(10) Patent No.: US 7,357,586 B2
(45) Date of Patent: Apr. 15, 2008

(54) IMAGE FORMING APPARATUS INCLUDING A PAPER FEEDING CASSETTE

(75) Inventor: Chang-min Youn, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/401,877

(22) Filed: Apr. 12, 2006

(65) Prior Publication Data

US 2006/0233584 A1 Oct. 19, 2006

(30) Foreign Application Priority Data

Apr. 14, 2005 (KR) ..... 10-2005-0031122

(51) Int. Cl.

| | |
|---|---|
| ***B41J 11/58*** | (2006.01) |
| ***B65H 3/06*** | (2006.01) |
| ***B65H 1/12*** | (2006.01) |
| ***B65H 1/14*** | (2006.01) |

(52) U.S. Cl. ..... 400/624; 271/126; 271/127; 399/393

(58) Field of Classification Search ..... 400/624; 271/3.08, 10.01, 18, 167, 169, 126, 127, 271/145, 147, 160; 399/393
See application file for complete search history.

(56) References Cited

U.S. PATENT DOCUMENTS

| | | | | |
|---|---|---|---|---|
| 4,874,159 | A * | 10/1989 | Maeno et al. | 271/171 |
| 5,046,714 | A | 9/1991 | Hwang | |
| 5,088,715 | A * | 2/1992 | Shibata et al. | 271/9.09 |
| 5,611,528 | A * | 3/1997 | Nakamura et al. | 271/164 |
| 5,634,188 | A * | 5/1997 | Johnston et al. | 399/393 |
| 5,967,681 | A * | 10/1999 | Leys et al. | 400/636 |
| 6,059,282 | A * | 5/2000 | Jang | 271/160 |
| 6,364,309 | B1 * | 4/2002 | Tomatsu | 271/160 |
| 6,648,323 | B2 * | 11/2003 | Hsieh | 271/126 |
| 6,939,068 | B2 * | 9/2005 | Rawlings et al. | 400/718 |
| 6,969,063 | B2 | 11/2005 | Park | |
| 2002/0003332 | A1 * | 1/2002 | Hiratani | 271/121 |
| 2003/0132570 | A1 * | 7/2003 | Park | 271/167 |
| 2006/0157914 | A1 * | 7/2006 | Suwa | 271/126 |

FOREIGN PATENT DOCUMENTS

| | | | |
|---|---|---|---|
| JP | 3-56326 | | 3/1991 |
| JP | 3056326 | * | 3/1991 |
| JP | 06156749 | * | 6/1994 |
| JP | 10059554 | * | 3/1998 |

(Continued)

OTHER PUBLICATIONS

Office Action issued fro Korean Patent Application No. 2005-31122 on May 25, 2006.

(Continued)

*Primary Examiner*—Matthew Luu
*Assistant Examiner*—Joshua M Dubnow
(74) *Attorney, Agent, or Firm*—Stein, McEwen & Bui, LLP

(57) ABSTRACT

An image forming apparatus including a paper feeding cassette to stack a print medium, wherein the paper feeding cassette includes a plate to support the print medium and which elevates substantially straight, and a supporting unit to support the elevation of the plate.

24 Claims, 7 Drawing Sheets

FOREIGN PATENT DOCUMENTS

| | | |
|---|---|---|
| KR | 1992-6160 | 7/1992 |
| KR | 1999-62291 | 7/1999 |
| KR | 10-251120 | 1/2000 |
| KR | 2004-19497 | 3/2004 |
| KR | 2004-22815 | 3/2004 |
| KR | 10-449024 | 9/2004 |

OTHER PUBLICATIONS

Abstract of Publication No. 10-245165 B1 issued on Nov. 26, 1999.

* cited by examiner

IMAGE FORMING APPARATUS INCLUDING A PAPER FEEDING CASSETTE

CROSS-REFERENCE TO RELATED APPLICATIONS

This application claims the benefit of Korean Application No. 2005-31122, filed Apr. 14, 2005, in the Korean Intellectual Property Office, the disclosure of which is incorporated herein by reference.

BACKGROUND OF THE INVENTION

1. Field of the Invention

An aspect of the present invention relates to an image forming apparatus comprising a paper feeding cassette, and, more particularly, to an image forming apparatus comprising a paper feeding cassette having an improved paper feeding structure.

2. Description of the Related Art

As shown in FIG. 1, a conventional paper feeding cassette 100 mounted at an image forming apparatus such as a printer, a fax, or a multi-operation printer comprises a frame 101, a knock-up plate 110 to tilt about a hinge shaft 111 coupled to the frame 101, an overlap supply preventing part 120 provided in front of a paper supply side of the knock-up plate 110. The knock-up plate 110 is supported by a spring 130, and tilts according to an amount of paper stacked on a top surface of the knock-up plate 110.

A pick-up roller 210 is mounted in front of the paper supply side of the knock-up plate 110 and is supported by a main body (not shown) of the image forming apparatus. The pick-up roller 210 picks up the uppermost paper from among the paper stacked on the knock-up plate 110 by an application of a rotational frictional force and supplies the uppermost paper to an image forming part (not shown) through the overlap supply preventing part 120. The overlap supply preventing part 120 is fixed at the frame 101 such that the overlap supply preventing part 120 creates a predetermined angle with respect to the knock-up plate 110. Also, a frictional pad 121 having a large coefficient of friction is attached to a surface of the overlap supply preventing part 120 to form a frictional surface.

Referring to FIGS. 2A and 2B, in a case in which a plurality of the papers are overlapped and supplied from the knock-up plate 110, the lowermost paper is stopped by the frictional force of the friction pad 121. As a result, only the uppermost paper is supplied to the image forming part.

With the knock-up plate 110 structure tilted and supported on the frame 101, referring to FIG. 2A, in a case in which the paper stacked on the knock-up plate 110 is small, an intermediate angle ($\theta$) becomes small, meanwhile, as referring to FIG. 2B, in case where the paper stacked on the knock-up plate 110 is large, the intermediate angle ($\theta'$) becomes large. As above, if the intermediate angle is changed according to amounts of the loaded paper, the frictional force generated by the friction pad 121 is also changed. In a case in which the frictional force applied to the paper 1 is large, that is, in case of FIG. 2B, feed quality may be deteriorated because the paper 1 may be supplied after being crumpled or undesirably folded at an edge of the paper because the paper 1 is caught at the overlap supply preventing part 120.

SUMMARY OF THE INVENTION

An aspect of the present invention provides for an image forming apparatus comprising a paper feeding cassette which provides a reasonable feed quality by improving a tilting structure of a knock-up plate.

According to an embodiment of the invention, there is provided an image forming apparatus comprising a paper feeding cassette to stack a print medium, wherein the paper feeding cassette comprises a plate to support the print medium and which elevates substantially straight, and a supporting unit to support the elevation of the plate.

The supporting unit comprises an elastic member. The elastic member comprises at least one of a coil spring, a leaf spring and/or a hydraulic spring, or a combination thereof. The paper feeding cassette further comprises a guiding unit to guide a straight elevating movement of the plate. The guiding part comprises a first guiding part formed at the paper feeding cassette and a second guiding part formed at the plate and elevating along the first guiding part.

The paper feeding cassette further comprises an auxiliary plate to support the print medium. The auxiliary plate has a part which is supported by the paper feeding cassette. The part of the auxiliary plate is tiltably supported by the paper feeding cassette. The supporting unit is driven by an electric power driving unit. The electric power driving unit comprises a motor. The supporting unit comprises a cam. The supporting unit is provided at a side of the plate. The paper feeding cassette further comprises an overlap supply preventing part having a friction surface with a predetermined angle with respect to the plate.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
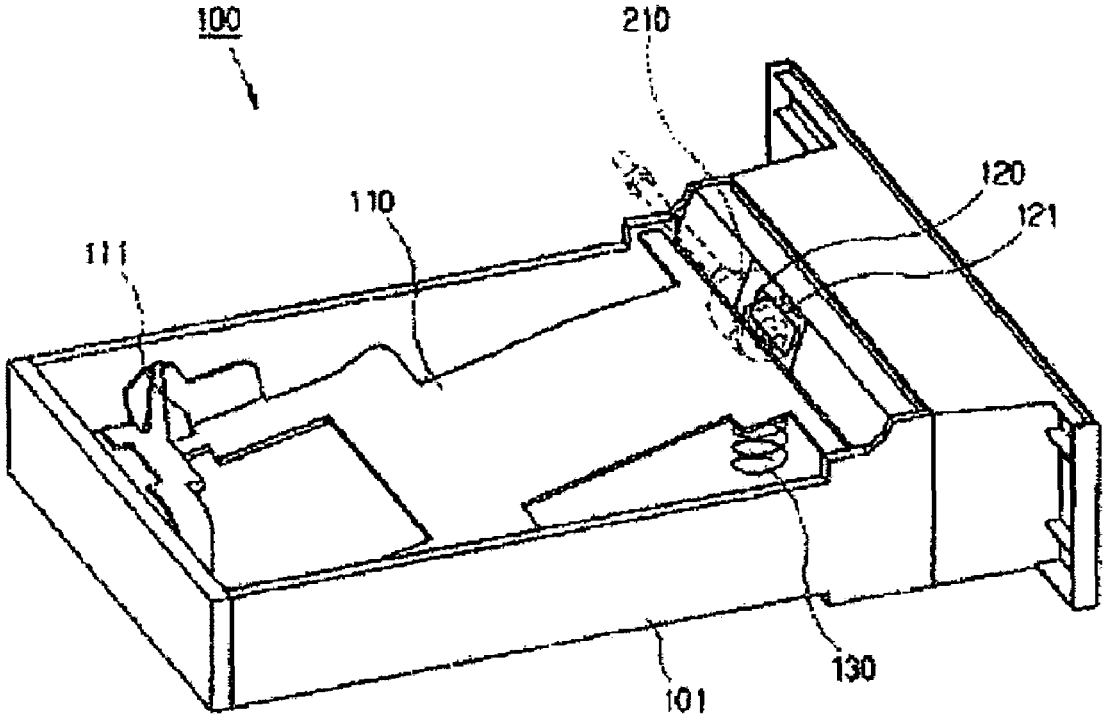
FIG. 1 (PRIOR ART)
FIG. 1 is a perspective view illustrating a conventional paper feeding cassette.
Figure 2A:
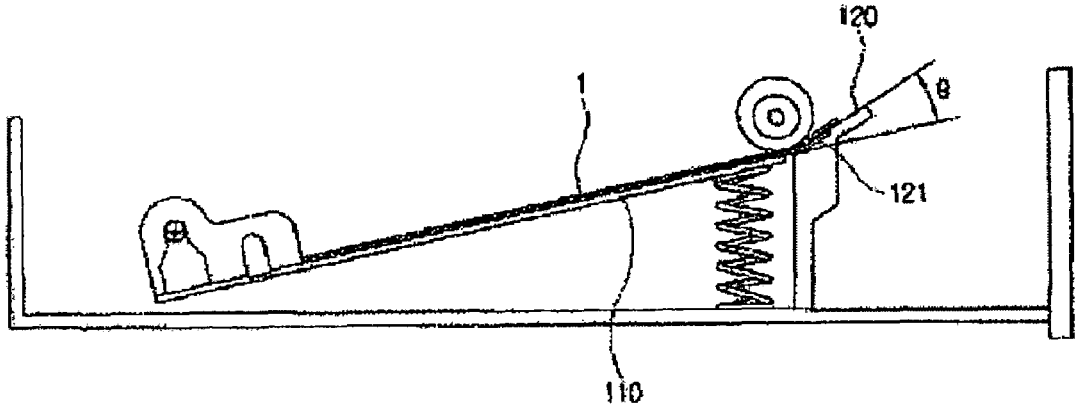
FIG. 2A (PRIOR ART)
FIGS. 2A and 2B are a sectional view illustrating in state of stacking paper on the paper feeding cassette of FIG. 1.
Figure 2B:
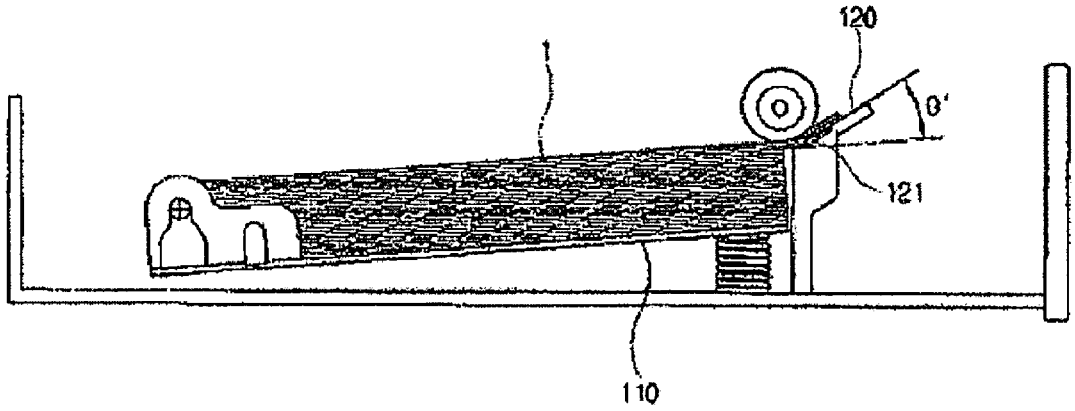
FIG. 2B (PRIOR ART)

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
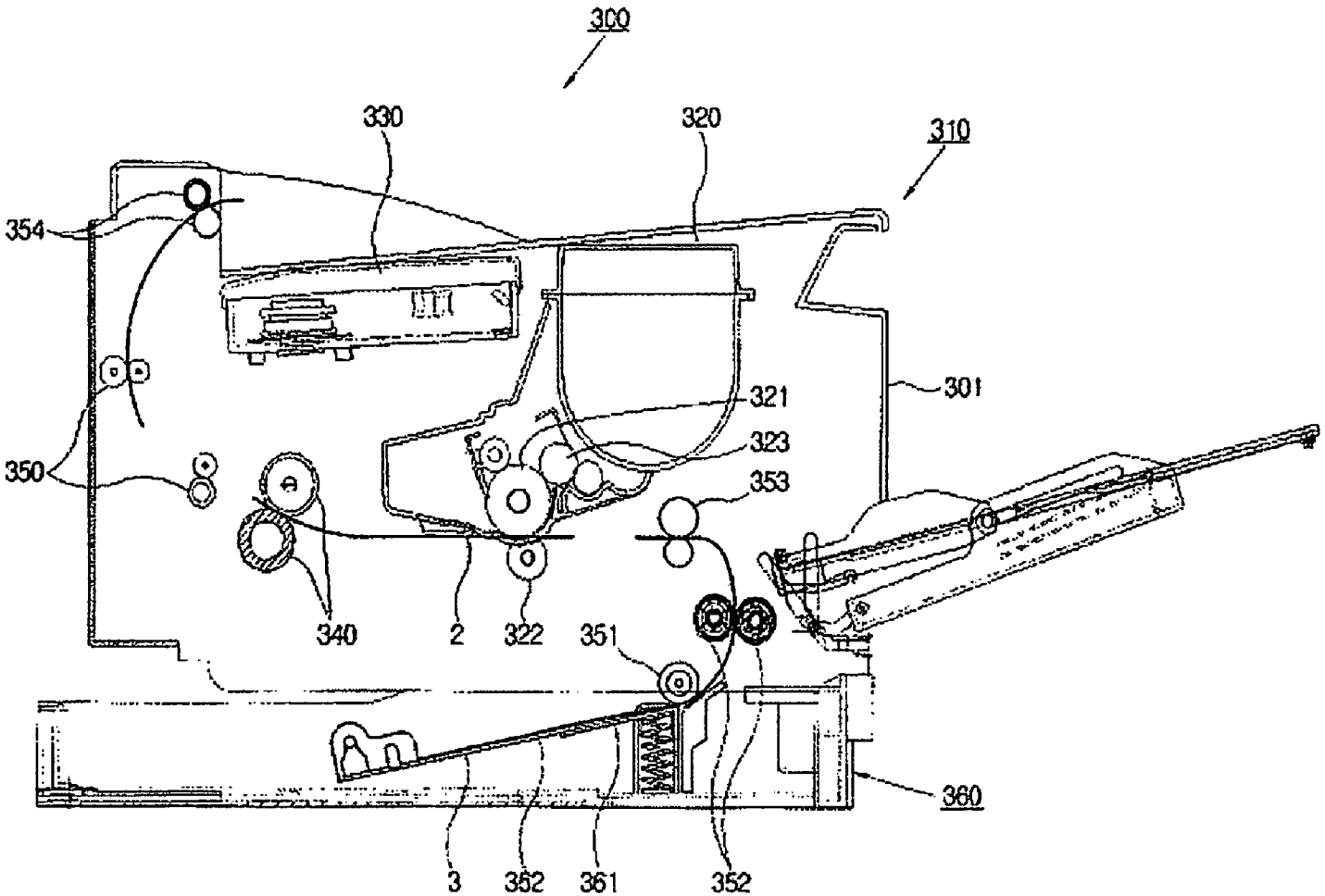
FIG. 3 is a sectional view illustrating an image forming apparatus according to an embodiment of the present invention.

Referring to FIG. 3, an image forming apparatus according to an embodiment of the present invention is a laser beam printer 300. The laser beam printer 300 comprises a printer main body 310 and a paper feeding cassette 360 mounted at a lower part thereof to supply paper as a print medium.

The printer main body 310 comprises a printer cartridge 320 detachably mounted to the printer main body 310; a scanning unit 330 to form a latent image on an OPC (opto photo-organic conductor) drum 321 of the printer cartridge 320; a transfer roller 322 to engage and rotate with the OPC drum 321 so as to place paper 2 therebetween; a fixing roller 340 to fix a toner that is transferred on the paper 2; a plurality of carry rollers 350; a pick-up roller 351 to pick up the paper 3 stacked on the paper feeding cassette 360; and a housing 301 to support the above elements.

Further, as not shown therein, the printer main body 310 comprises a driving part to drive the elements, a controller to control the driving part, and a display part to display an operating state of the printer. If a print command is input, the paper 3 stacked on a plate 361 and an auxiliary plate 362 of the paper feeding cassette 360 is picked up by the pick-up roller 351 and is supplied to a register roller 353 through a carry roller 352, and then passes between the OPC drum 321 and the transfer roller 322. The latent image is formed on a surface of the OPC drum 321 by the light emitted from the scanning unit 330, and the toner supplied from a developing roller 323 is transferred onto the paper 2 by electric power of the transfer roller 322. The toner transferred onto the paper 2 is heated and pressurized on the paper 2 as the paper 2 passes through the fix roller 340. Then, the paper 2 is discharged outside of the printer main body 310 through the carry rollers 350 and a discharge roller 354.

Figure 4:
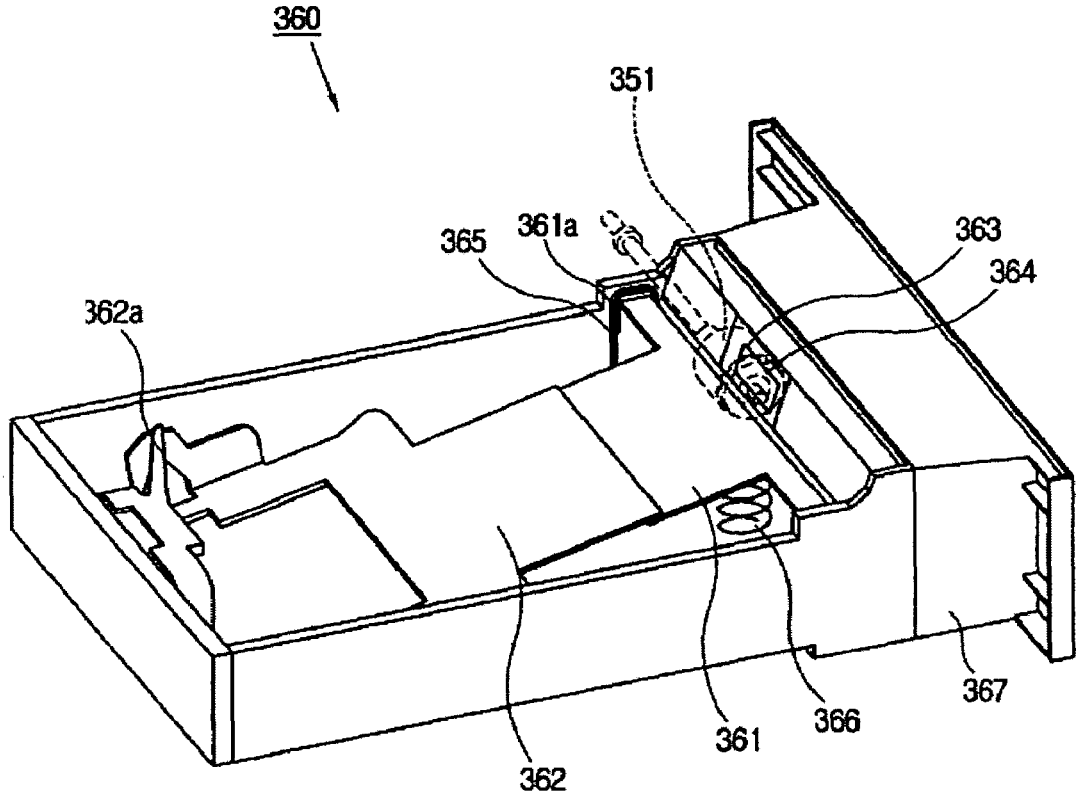
FIG. 4 is a perspective view illustrating a paper feeding cassette of the image forming apparatus of the FIG. 3.
Figure 5A:
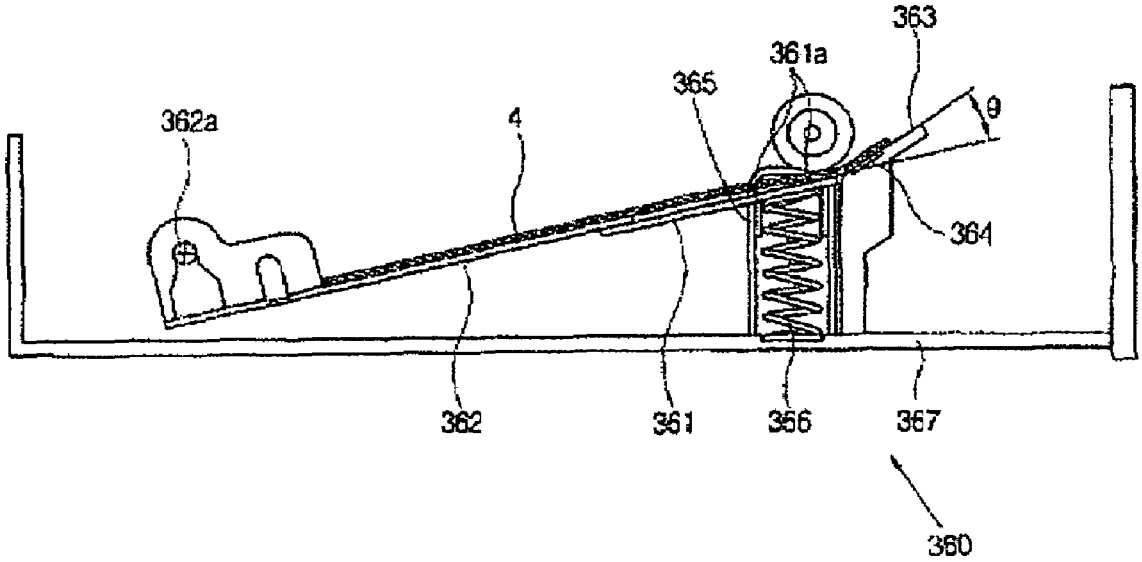
FIGS. 5A and 5B are a sectional view illustrating in state of stacking paper on the paper feeding cassette of FIG. 4.
Figure 5B:
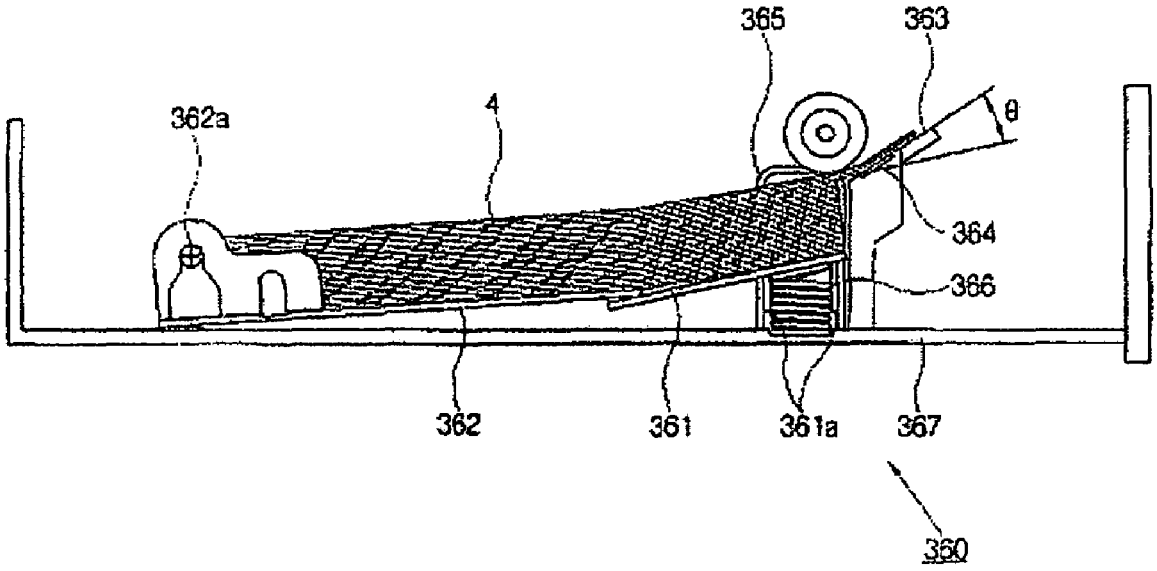

Referring to FIGS. 4, 5A and 5B, the paper feeding cassette 360 comprises the following features. An overlap supply preventing part 363 having a frictional surface 364 prevents paper from being overlapped and supplied in the overlapped condition. A plate 361 maintains a predetermined intermediate angle (θ) with respect to the frictional surface 364 of the overlap supply preventing part 363. Further, the plate elevates in substantially straight lines. A first guiding part 365 and second guiding parts 361*a* are used as a guiding unit to guide the elevation of the plate 361. A spring 366 supports and causes the plate 361 to elevate straightly according to amounts of the paper 4 stacked on the plate 361, and a frame 367 supports the above features.

Herein, the spring 366, being used as an elastic member, is a supporting unit to elevate the plate 361. The spring 366, according to an embodiment of the present invention, may include a coil spring, a leaf spring, or a fluid spring, etc. Also, above the spring, according to an embodiment of the invention, one or more springs, or a similar feature, may be used to increase the elastic effectiveness of the spring 366.

The overlap supply preventing part 363 is fixed and supported by the frame 367 in a state in which the overlap supply preventing part 363 makes the predetermined intermediate angle (θ) with respect to the plate 361, and is provided with a frictional surface 364 to which a frictional pad having a large coefficient of friction, such as a rubber pad, is attached. In a case in which a plurality of papers picked up from the plate 361 by the pick-up roller 351 is supplied to the frictional surface 364, the lowermost paper of the plurality of papers is contacted and stopped by the frictional surface 364. Similarly, the next lowermost paper is also contacted and stopped. Thus, only the uppermost paper thereof is supplied.

The plate 361 is mounted to face the overlap supply preventing part 363, and makes the predetermined intermediate angle (θ) with respect to the frictional surface 364 of the overlap supply preventing part 363. The predetermined intermediate angle (θ) is determined so as to provide the optimum conditions to prevent the paper 4 from being overlapped and supplied in that condition.

The plate 361 elevates up and down in substantially straight lines due to the cooperation of the first guiding part 365 and the second guiding parts 361 a that are projected from a side of the plate 361. The first guiding part 365 may be formed on an inside wall of the frame 367, to correspond in position to positions of the second guiding parts 361*a*. The first guiding part 365 and the second guiding parts 361*a* serve to guide the straight elevating movement of the plate 361. Therefore, in a case in which the plate 361 elevates up and down along the first guiding part 365, the predetermined intermediate angle (θ) between the plate 361 and the frictional surface 364 is maintained.

According to an embodiment of the invention, the first guiding part 365 and the second guiding parts 361*a* are respectively provided at edges of the plate 361 as one combined unit. Alternately, according to another embodiment of the invention, the first guiding part 365 and the second guiding parts 361*a* may be respectively provided as a plurality of separate units. Further, a breadth of the first guiding part 365 and the second guiding parts 361*a* may be set up widely or narrowly, as necessary.

In addition, the first guiding part 365 and the second guiding parts 361*a* may be located in front of a lateral edge of the plate 361, that is, an edge of a feeding side of the plate 361 near the pick up roller 351, as shown in the embodiment of the present invention illustrated in FIGS. 5A and 5B. However, the present invention is not limited to this arrangement. The first guiding part 365 and the second guiding parts 361*a* may be alternately located in a middle or in a rear of the lateral edge of the plate 361.

Further, the first and the second guiding parts 365 and 361*a* generate friction during the elevating operations. The friction may result in a generation of elevator resistance and noise. Accordingly, to minimize elevator resistance and noise, a roller (not shown), which may roll along the first guiding part 365, may be added to or substituted for the second guiding part 361*a*.

Alternatively, according to another embodiment of the invention, the plate 361 is provided with a guide bar (not shown) to elevate the plate 361. Here, the first guiding part 365 is substituted for a member with a guide hole (not shown) to allow the guide bar to be inserted therein.

A lower part of the spring 366 is supported by the frame 367. The spring 366 elastically pressurizes the plate 361 in an upward direction such that the uppermost paper 4, stacked on the upper surface of the plate 361, corresponds in height to a height of a surface of the overlap supply preventing part 363. In another embodiment, the spring 366 may be substituted for with a supporting unit that comprises a cam, a lever, and a piston which are driven by an electric power driving unit, such as an electric motor, as well as the spring. In such a case, the present invention comprises a sensor (not shown) to sense the uppermost position of the paper 4 stacked on the plate 361, and a controller (not shown) to control the electric power driving unit by a sensed signal of the sensor. The sensor and the controller may be provided in the printer main body 310 of the laser beam printer (refer to 300 of FIG. 3). The application of such a technical feature is disclosed in entitled "paper feeding device" in Korean Patent Application No. 2005-27943 the disclosure of which is incorporated herein by reference.

If the plate 361 is long enough to support the stacked paper 4 an auxiliary plate is not necessary. However, if the plate 364 is not long enough to provide the proper support, according to an embodiment of the invention, an auxiliary plate 362 may be used. This condition may take effect when the plate 361 is similar to the length of the knock-up plate (refer to 110 of FIG. 1) when the plate 361 maintains the predetermined intermediate angle (θ) with respect to the frictional surface 364 of the overlap supply preventing part 363. Here, the plate 367 may not be able to elevate properly due to contact between the plate 361 and a bottom surface of the frame 367. In such a case, a length of the plate 361 is limited so as to accommodate the maximum stackable amounts of the paper 4.

In a case in which only the plate 361 supports the stacked paper 4, an embodiment of the present invention further comprises a supporting bar (not shown) to support a rear edge of the paper 4 so that the paper 4 stacked on the frame 367 is substantially prevented from dropping.

The auxiliary plate 362 is contacted and supported on a rear edge of the plate 361. The auxiliary plate 362 may tilt freely about a hinge part 362*a*, supported on the frame 367, upon being contacted by the plate 361 in accordance with the elevating of the plate 361. Here, the auxiliary plate 362 slides on the plate 361 during the tilting. As such, the plate 361 and the auxiliary plate 362 should be separate features.

In another embodiment, the plate 361 and the auxiliary plate 362 may be a rigid body that is supported by the first guiding part 365 and the hinge part 362*a* such that the body is horizontally stationary. According to this embodiment, if the auxiliary plate 362 is able to provide a supporting force that is capable of supporting the stacked paper 4 alone, the auxiliary plate 362 may be fixed to the plate 361. The auxiliary plate 362, as well as the plate 361, then support the paper 4.

FIGS. 5A and 5A are sectional views illustrating a stacking of paper 4 on the paper feeding cassette 360. As shown therein, the intermediate angle (θ) between the upper paper 4 and the frictional surface 364 of the overlap supply preventing part 363 is maintained regardless of the amount of the paper 4 that is stacked on the plate 361 and the auxiliary plate 362. Therefore, the frictional force generated by the frictional surface 364 is maintained. As a result, an incidence of crumbled paper and/or the edge folding phenomenon is reduced.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising:

a print medium feeding cassette on which at least one print medium is stacked, wherein the print medium feeding cassette comprises:

a plate to support the print medium and to elevate the print medium in a substantially vertical direction, the plate having an incline with respect to a bottom of the print medium feeding cassette, a supporting unit to support the elevation of the plate, and an auxiliary plate tiltably supported at a first end of the auxiliary plate by the print medium feeding cassette and supported at a second end of the auxiliary plate by the plate, wherein, as a number of individual print media of the print medium decreases, the plate and the auxiliary plate together form an increasingly planar surface having the incline with respect to the bottom of the print medium feeding cassette.

2. The image forming apparatus of claim 1, wherein the supporting unit comprises an elastic member.

3. The image forming apparatus of claim 2, wherein the elastic member comprises at least one of a coil spring, a leaf spring and a hydraulic spring.

4. The image forming apparatus of claim 1, wherein the print medium feeding cassette further comprises a guiding unit to guide the elevation of the plate.

5. The image forming apparatus of claim 4, wherein the guiding unit comprises a first guiding part formed at the print medium feeding cassette and a second guiding part formed at the plate and elevating along the first guiding part.

6. The image forming apparatus of claim 1, wherein the supporting unit is driven by an electric power driving unit.

7. The image forming apparatus of claim 6, wherein the electric power driving unit comprises a motor.

8. The image forming apparatus of claim 6, wherein the supporting unit comprises a cam.

9. The image forming apparatus of claim 1, wherein the supporting unit is provided at a side of the plate.

10. The image forming apparatus of claim 1, wherein the print medium feeding cassette further comprises an overlap supply preventing part having a frictional surface with a predetermined angle with respect to the plate.

11. A feed cassette to be used with an image forming apparatus, the cassette comprising:

a feed cassette frame;

a plate, on which a print medium to be supplied to the apparatus is stacked, to be biased to elevate the print medium in opposition to a weight of the print medium, the plate being inclined with respect to a bottom of the feed cassette frame;

an overlap supply preventing part having a frictional surface to prevent the print medium from being overlappingly supplied to the apparatus;

a guiding unit connected to the frame and the plate to guide the elevation of the plate such that the plate maintains a predetermined angle with the overlap supply preventing part; and an auxiliary plate tiltably supported at a first end of the auxiliary plate by the feed cassette frame and supported at a second end of the auxiliary plate by the plate, wherein, as a number of individual print media of the print medium decreases, the plate and the auxiliary plate together form an increasingly planar surface having the incline with respect to the bottom of the print medium feeding cassette.

12. The cassette according to claim 11, wherein the weight of the print medium is based on a number of pieces of print medium stacked on the plate.

13. The cassette according to claim 11, further comprising an elastic member to bias the plate in opposition to the weight of the print medium.

14. The cassette according to claim 13, wherein the frictional surface comprises a rubber pad attached to the overlap supply preventing part.

15. The cassette according to claim 13, wherein the elastic member comprises a spring, a lower part of which is supported by the frame.

16. The cassette according to claim 11, wherein the predetermined angle is determined so as to prevent the print medium from being overlappingly supplied to the apparatus.

17. The cassette according to claim 11, wherein the guiding unit comprises a first guiding part and second guiding parts respectively supported by one of the frame and the plate.

18. The cassette according to claim 11, wherein the guiding unit comprises:

a first guiding part formed on an inside wall of the frame; and second guiding parts projected from respective sides of the plate to correspond in position to a position of the first guiding part.

19. The cassette according to claim 18, wherein the first guiding part and the second guiding parts are respectively provided at edges of the plate as one combined unit.

20. The cassette according to claim 18, wherein the first guiding part and the second guiding parts are located in front of a lateral edge of the plate.

21. The cassette according to claim 11, wherein the auxiliary plate rotates during the elevation of the plate.

22. The cassette according to claim 11, wherein the plate and the auxiliary plate are rigid with respect to each other.

23. An image forming apparatus to which the feed cassette of claim 11 is attached.

24. The image forming apparatus according to claim 23, wherein the apparatus is a laser printer.

* * * * *